US009861148B2

(12) United States Patent
Alex

(10) Patent No.: US 9,861,148 B2
(45) Date of Patent: Jan. 9, 2018

(54) PROCESS FOR CREATING TRANSITORY COLORED HAIR FOR HAIR EXTENSIONS AND WIG HAIR

(71) Applicant: Gunter Alex, Deutschland (DE)

(72) Inventor: Gunter Alex, Deutschland (DE)

( * ) Notice: Subject to any disclaimer, the term of this patent is extended or adjusted under 35 U.S.C. 154(b) by 187 days.

(21) Appl. No.: 15/010,543

(22) Filed: Jan. 29, 2016

(65) Prior Publication Data

US 2017/0215504 A1 Aug. 3, 2017

(51) Int. Cl.
*A41G 3/00* (2006.01)
*A41G 5/00* (2006.01)

(52) U.S. Cl.
CPC ..... *A41G 3/0075* (2013.01); *A41G 5/004* (2013.01)

(58) Field of Classification Search
CPC ..... A45D 5/00; A45D 5/004; A45D 5/0046; A45D 5/008; A45D 3/0075; A45D 2008/004; A45D 2019/0075; A45D 2019/0091; A45D 2007/001
See application file for complete search history.

(56) References Cited

U.S. PATENT DOCUMENTS 8,434,500 B2 5/2013 Alex
2006/0266376 A1* 11/2006 Basso ..... A41G 5/00 132/201

* cited by examiner

*Primary Examiner* — Rachel Steitz
(74) *Attorney, Agent, or Firm* — Robert C. Kain, Jr.

(57) ABSTRACT

A process for creating transitory colored hair that is composed of two different colored hair groups having different length hairs in each hair group, and the hair groups are combined then the top one-third (⅓) combined hair is dyed or color processed. First, hair group 1 is obtained consisting of hair strands 12 inches to 24 inches in length and color processed to color A. Next, hair group 2 is obtained consisting of hair strands approximately two-thirds the length of hair group 1, which is color processed to color B. Hair group 1 and hair group 2 are combined into one hair piece. Then, the top one-third segment of combined hair is color processed to color B. Optionally, the top one-third segment of the combined hair groups can be color processed to color C.

21 Claims, 4 Drawing Sheets
(1 of 4 Drawing Sheet(s) Filed in Color)

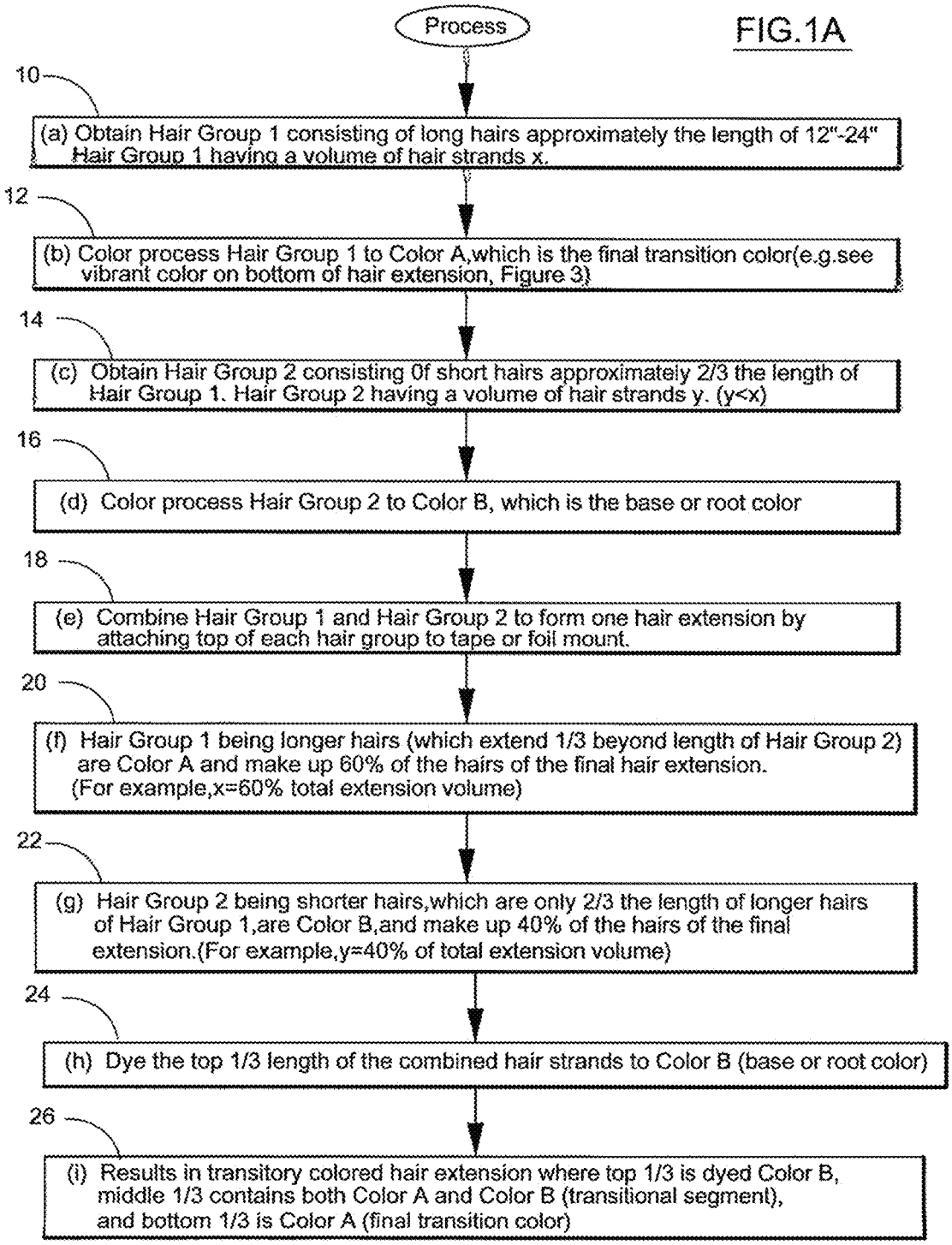
Process
FIG.1A
10
(a) Obtain Hair Group 1 consisting of long hairs approximately the length of 12"-24" Hair Group 1 having a volume of hair strands x.
12
(b) Color process Hair Group 1 to Color A,which is the final transition color(e.g.see vibrant color on bottom of hair extension, Figure 3)
14
(c) Obtain Hair Group 2 consisting 0f short hairs approximately 2/3 the length of Hair Group 1. Hair Group 2 having a volume of hair strands y. (y<x)
16
(d) Color process Hair Group 2 to Color B, which is the base or root color
18
(e) Combine Hair Group 1 and Hair Group 2 to form one hair extension by attaching top of each hair group to tape or foil mount.
20
(f) Hair Group 1 being longer hairs (which extend 1/3 beyond length of Hair Group 2) are Color A and make up 60% of the hairs of the final hair extension. (For example,x=60% total extension volume)
22
(g) Hair Group 2 being shorter hairs,which are only 2/3 the length of longer hairs of Hair Group 1,are Color B,and make up 40% of the hairs of the final extension.(For example,y=40% of total extension volume)
24
(h) Dye the top 1/3 length of the combined hair strands to Color B (base or root color)
26
(i) Results in transitory colored hair extension where top 1/3 is dyed Color B, middle 1/3 contains both Color A and Color B (transitional segment), and bottom 1/3 is Color A (final transition color)

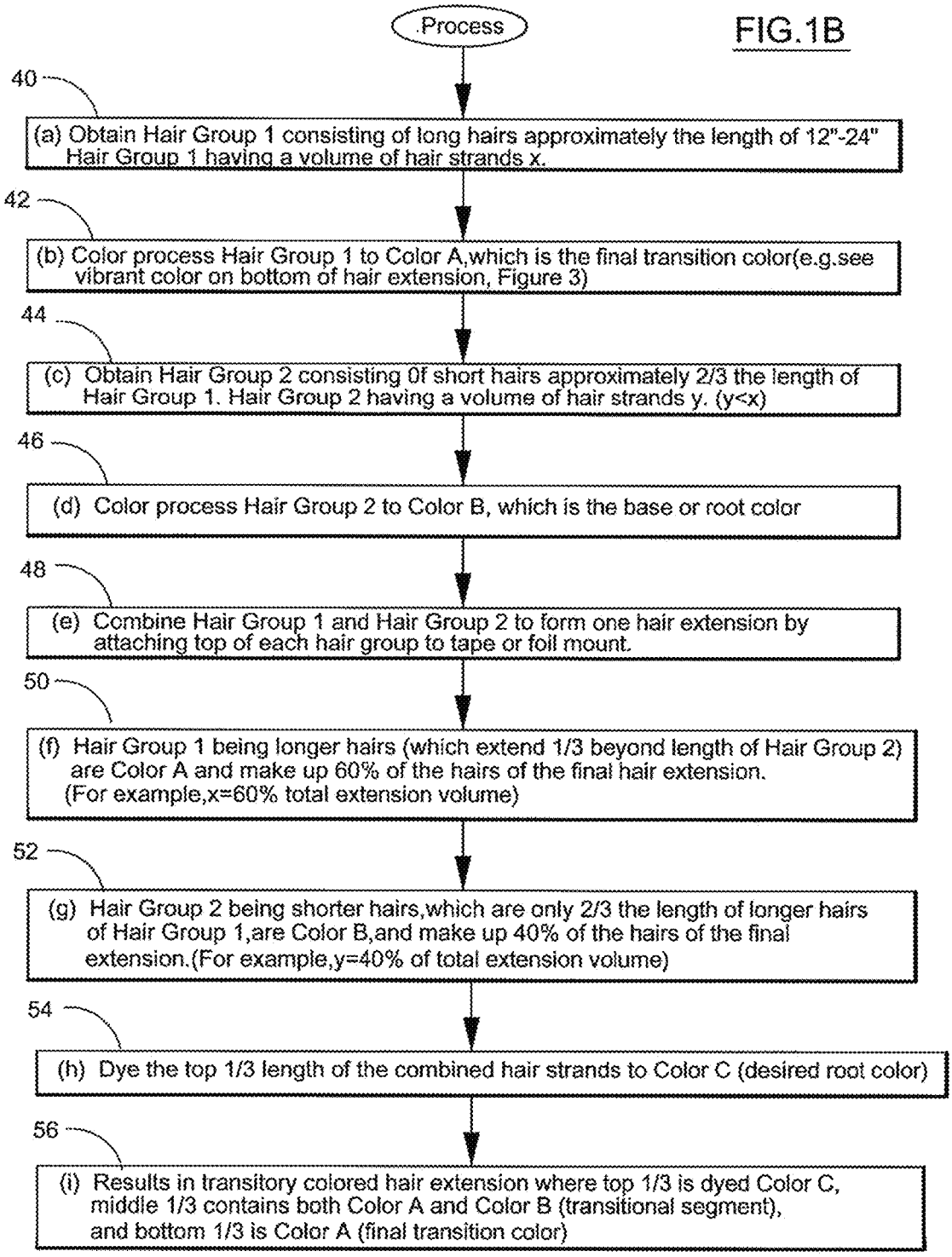
Process
FIG.1B
40
(a) Obtain Hair Group 1 consisting of long hairs approximately the length of 12"-24" Hair Group 1 having a volume of hair strands x.
42
(b) Color process Hair Group 1 to Color A,which is the final transition color(e.g.see vibrant color on bottom of hair extension, Figure 3)
44
(c) Obtain Hair Group 2 consisting 0f short hairs approximately 2/3 the length of Hair Group 1. Hair Group 2 having a volume of hair strands y. (y<x)
46
(d) Color process Hair Group 2 to Color B, which is the base or root color
48
(e) Combine Hair Group 1 and Hair Group 2 to form one hair extension by attaching top of each hair group to tape or foil mount.
50
(f) Hair Group 1 being longer hairs (which extend 1/3 beyond length of Hair Group 2) are Color A and make up 60% of the hairs of the final hair extension. (For example,x=60% total extension volume)
52
(g) Hair Group 2 being shorter hairs,which are only 2/3 the length of longer hairs of Hair Group 1,are Color B,and make up 40% of the hairs of the final extension.(For example,y=40% of total extension volume)
54
(h) Dye the top 1/3 length of the combined hair strands to Color C (desired root color)
56
(i) Results in transitory colored hair extension where top 1/3 is dyed Color C, middle 1/3 contains both Color A and Color B (transitional segment), and bottom 1/3 is Color A (final transition color)

PROCESS FOR CREATING TRANSITORY COLORED HAIR FOR HAIR EXTENSIONS AND WIG HAIR

The patent or application file contains a drawing executed in color. Copies of this patent with a color drawing will be provided by the Office upon request and payment of the necessary fee.

This is a regular, nonprovisional patent application.

The present invention relates to a process for creating transitory colored hair for hair extensions and wig hair.

BACKGROUND OF THE INVENTION

It is increasingly fashionable to have hair with a different color on the terminal end portion or hair segments furthest from the scalp. The hair can be darker on top and lighter near the ends or vice versa. For a more dramatic look, the end portion of the hair can be vibrantly colored with colors such as blue, lavender, pink, green, orange, etc. This look is often achieved by dying or color processing the end portions of a person's hair with vibrant colored dye. However, color processing the hair is a semi-permanent or permanent process, when in fact the person may only want the colored hair to last for a day.

Hair extensions and wigs are known. Hair extensions are lengths of hair attachable to a user's head to make the user's hair appear either fuller, longer or add color. Wigs likewise can be used to change the appearance of the user's hair.

The current invention provides a process for creating transitory colored hair for hair extensions and wig hair which overcomes the forgoing disadvantages of the above mentioned hair color processing issues.

OBJECTS OF THE INVENTION

It is an object of the present invention to provide a process for creating transitory colored hair for extensions and wigs. The process provides a hair piece that has three visually distinct segments with a top segment nearest the user's scalp, a middle segment and a bottom segment composed of the terminal ends of the hair strands. The segments are each a different visible color. The top segment is a first solid color, the middle segment is a transitory color that contains a mixture of hair strands being the top segment color and the bottom segment color, and the bottom segment is a second solid color.

It is also an object of the present invention to provide transitory colored hair for an extension or wig that is easy to use for a short duration and does not require the user to permanently or semi-permanently dye or color process their natural hair. An extension or wig provides the desired look without the user having to perform the work of color processing their hair, undertake the expense of having it done and subject their own hair through possible damage.

SUMMARY OF THE INVENTION

The present invention provides a process for creating transitory colored hair for an extension or wig. First, obtain hair group 1 consisting of hair strands 12 inches to 24 inches in length. Color process hair group 1 to color A. Next obtain hair group 2 consisting of hair strands approximately two-thirds the length of hair group 1. Color process hair group 2 to color B. Combine hair group 1 and hair group 2. Then, color process the top one-third segment of combined hair to color B. Optionally, the top one-third segment of the combined hair groups can be color processed to color C.

The present invention provides a process for making transitory colored hair for extensions or wigs having colors that segregate the longitudinal hair strands into three horizontal sections. There is a top one-third segment adapted to be attached near a user's scalp having hair strands a color B. A middle one-third segment having hair strands of colors A and B, and a bottom one-third segment composed of the terminal ends of the hair strands having color A. Optionally, the top one-third segment adapted to be attached near a user's scalp has hair strands a color C.

The present invention provides transitory colored hair for extensions or wigs having colors that segregate the longitudinal hair strands into three horizontal sections. The top segment is adapted to be attached near a user's scalp having hair strands of a first solid color, a bottom segment composed of a terminal ends of the hair strands having a second solid color, and a middle segment having hair strands having a mixture of the first solid color and the second solid color forming a transitory color.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention will be apparent from the following detailed description when taken in conjunction with the accompanying drawings.

FIG. 1 A is a process flow diagram showing the process for making a transitory hair extension or wig using two colors.

FIG. 1B is a process flow diagram showing the process for making a transitory hair extension or wig using three colors.

DETAILED DESCRIPTION OF THE PREFERRED EMBODIMENTS

Figure 2A:
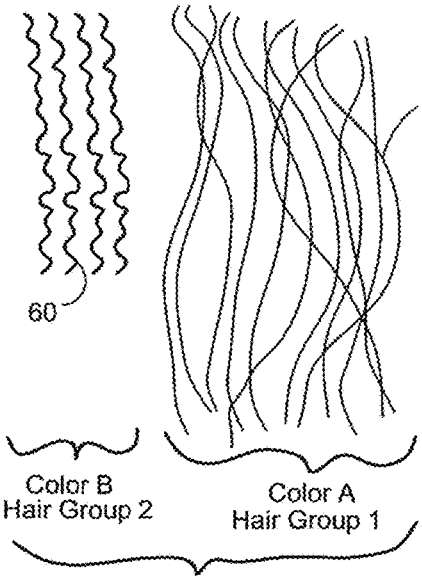
FIGS. 2A, 2B and 2C are process schematics showing the starting elements, combination and final color processing step.

Referring now to the drawings, the invention will be described in more detail. It is important to note that the embodiments of the invention described below are only examples of the several advantageous uses of the innovative teachings described herein. In general, statements made in the specification of the present application do not necessarily limit any of the various claimed inventions. Moreover, some statements may apply to some inventive features but not to others. In general, unless otherwise indicated, singular elements may be in the plural and vice versa with no loss of generality.

The transitory colored hair has the appearance of having three colors that transition into each other. Herein, the transitory colored hair will generally be referred to for use in hair extensions or wigs, however, it is under stood that the color process and method of manufacture can be used on extensions, hair clip pieces, hair bands, wigs and any other known device that contains hair strands. The colors segregate the longitudinal hair strands into three visually distinct horizontal sections with a top segment nearest the user's scalp, a middle segment and a bottom segment composed of the terminal ends of the hair strands. Thus, there is a one-third (⅓) top segment, a one-third (⅓) middle segment and a one-third (⅓) bottom segment of the hair strands. The transitory colored hair is composed of two different colored hair groups having different length hairs in each hair group, that are combined then the top one-third (⅓) segment of the combined extension is dyed or color processed.

In FIG. 1A, a process for creating transitory colored hair for use in hair extensions and wig hair is shown. In step 10, hair group 1 (a first hair group consisting of a first plurality of hair strands) is obtained, which consists of long hairs that are approximately twelve (12") to twenty-four (24") inches in length (a first predetermined length). H-lair group 1 has a volume or number of hair strands being "x," wherein x is a percentage of the total volume of the final hair piece. In step 12, hair group 1 is color processed or dyed to color A (a first color). Color A is the final transition color. In some embodiments, color A is a vibrant color, such as blue, pink, red, or purple (e.g. a color that does not naturally occur in hair.) In the final hair piece, color A will appear as the only color on the bottom one-third (⅓) segment of the hair extension or wig.

In step 14, hair group 2 (a second hair group consisting of a second plurality of hair strands) is obtained, which consists of short hairs of predetermined length that are approximately two-thirds (⅔) the length of hair group 1. Hair group 2, consisting of a number of hair strands, has a volume or number of hair strands being "y," wherein y is a percentage of the total volume of the final hair piece. In the preferred embodiment, y hair volume will be less than x hair volume ($y<x$).

In step 16, hair group 2 is color processed to color B (a second color). Color B is a base or root color. In the preferred embodiment, color B is a variation of a natural hair color, such as a shade of brown, black or blonde.

In step 18, hair group 1 and hair group 2 are combined or joined together to form one hair extension or wig. The respective ends of both hair groups are mounted or joined together by a hair extension element (tape or foil mount system). Hair group 1 and hair group 2 can be combined with known methods, such as by tape, foil, stitching, or attachment to a base. The combined structure may also become part of the attachment means to the user's head or hair. An example of a foil mount is shown and described in U.S. Pat. No. 8,434,500 the contents of which is incorporated herein by reference thereto.

As shown in Step 20, hair group 1 contains longer hairs, which extend one-third (⅓) beyond the length of hair group 2. Hair group 1 is colored color A and makes up x % of the total volume of the joined together hair extension. In the preferred embodiment, hair group 1 is 60% of the total volume of the entire extension. As shown in Step 22, hair group 2 contains hairs that are shorter than those in hair group 1. The hairs in hair group 2 are two-third (⅔) the length of the longer hairs of hair group 1. Hair group 2 is colored color B and makes up y % of the total volume of the hair extension. The "total volume" being all the hair strand in the wig or hair extension. In the preferred embodiment, hair group 2 is 40% of the total volume of the entire extension or wig.

In Step 24, the top one-third (⅓) length of the combined hair, which will be mounted nearest the user's head, is color processed or dyed to color B, which is the base or root color.

In Step 26, the resulting product is a transitory colored hair extension where the top one-third (⅓) segment is color processed to color B, the middle one-third (⅓) segment contains both color A and color B hair strands (transitional segment) and the bottom one-third (⅓) segment of the extension is color A, which is the final transition color.

Figure 3:
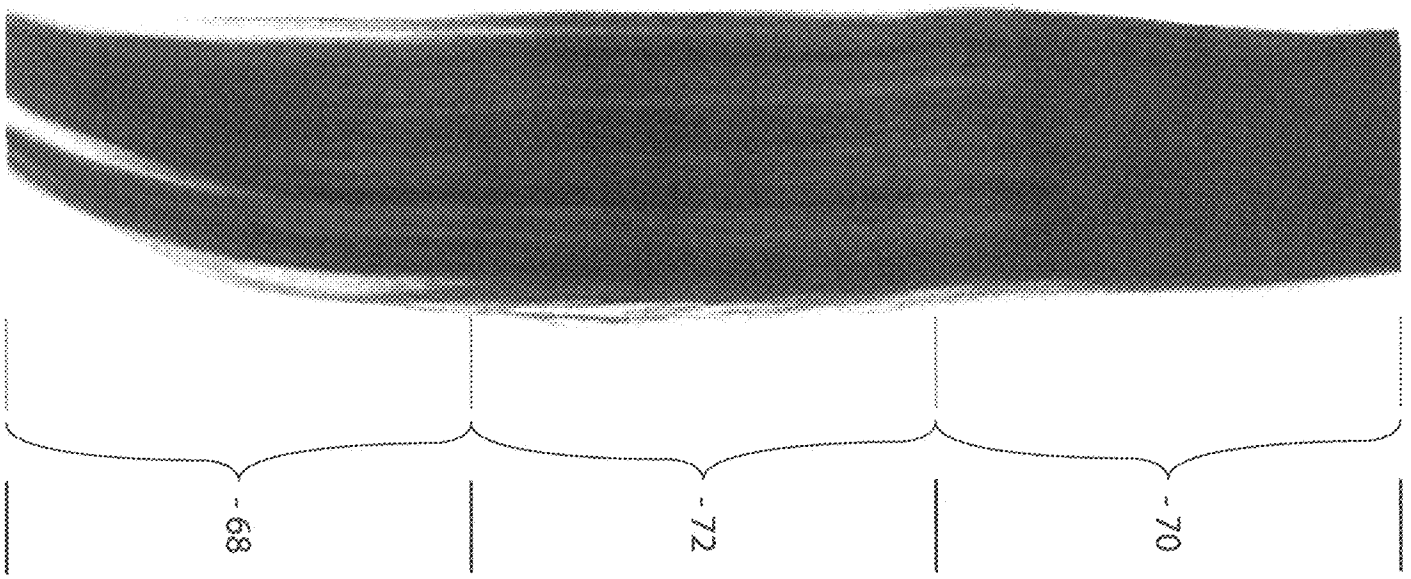
FIG. 3 is a color photograph showing a sample hair extension.

As shown in FIG. 3, the top one-third (⅓) segment 70 of the hair is a base or root color, which in the shown extension is a dark brown. The middle one-third (⅓) segment 72 of the extension is a transition segment, which in the shown extension is a mixture of dark brown strands and purple strands. The bottom one-third (⅓) segment 68 of the hair extension is a purple color alone.

Colors A and B (and color C as diagrammatically shown in FIG. 1B) may be a variety of colors. The colors can all be shades of natural hair colors that when used in the transitory hair process appear to create ombre or reverse ombre coloring styles, i.e. shades from light to dark or dark to light with the transitory middle segment. Alternatively, colors A, B and/or C may be vibrant colors and natural hair colors creating an ombre effect with the natural and vibrant colors and include a transitory middle segment.

As shown in FIG. 1B, a process for creating transitory colored hair for hair extensions and wig hair is shown. In step 40, hair group 1 is obtained, which consists of long hairs that are approximately twelve (12") to twenty-four (24") inches in length. Hair group 1 has a volume of hair strands being "x," wherein x is a percentage of the total volume of the final hair piece. In step 42, hair group 1 is color processed or dyed to color A. Color A is the final transition color. In some embodiments, color A is a vibrant color, such as blue, pink, red, or purple (e.g. a color that does not naturally occur in hair.) Color A will appear as the only color on the bottom (⅓) segment of the hair extension. In step 44, hair group 2 is obtained, which consists of short hairs that are approximately two-thirds (⅔) the length of hair group 1. Hair group 2 has a volume of hair strands being "y," wherein y is a percentage of the total volume of the final hair piece. In the preferred embodiment, y will be less than x ($y<x$).

In step 46, hair group 2 is color processed to color B. Color B is a base or root color. In the preferred embodiment, color B is a variation of a natural hair color, such as a shade of brown, black or blonde. In step 48, hair group 1 and hair group 2 are combined to form one hair extension or wig. Hair group 1 and hair group 2 can be combined with known methods, such a by tape, foil or stitching. The combination structure may also form the attachment means or structure.

As shown in Step 50, hair group 1 contains longer hairs, which extend one-third (⅓) beyond the length of hair group 2. Hair group 1 is colored color A and makes up x percentage of the total volume of the hair extension. In the preferred embodiment, hair group 1 is 60% of the total volume of the entire extension or hair piece. As shown in Step 52, hair group 2 contains hairs that are shorter than those in hair group 1. The hairs in hair group 2 are two-thirds (⅔) the length of the longer hairs of hair group 1. Hair group 2 is colored color B and makes up y percentage of the total volume of the hair extension. In the preferred embodiment, hair group 2 is 40% of the total volume of the entire extension or hair piece.

In Step 54, the top one-third (⅓) length of the hair to be mounted nearest the user's head is dyed or color processed to color C, which is slightly lighter or darker than color B. In the preferred embodiment, color C is a lighter or darker shade of color B. In Step 56, the resulting product is a transitory colored hair extension where the top one-third (⅓) segment is dyed or color processed to color C, the middle one-third (⅓) segment contains both color A and color B (transitional segment), and the bottom (⅓) segment of the extension is Color A, which is the final transition color.

Figure 2B:
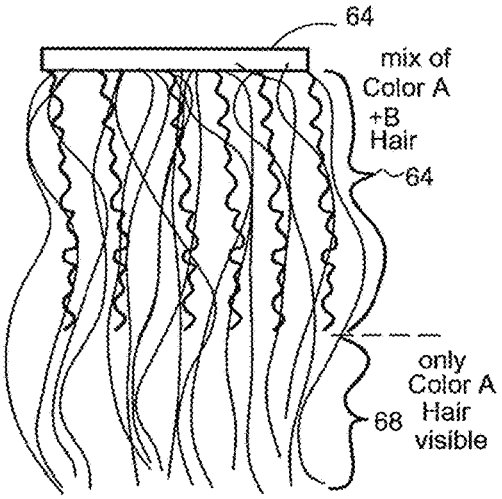
Figure 2C:
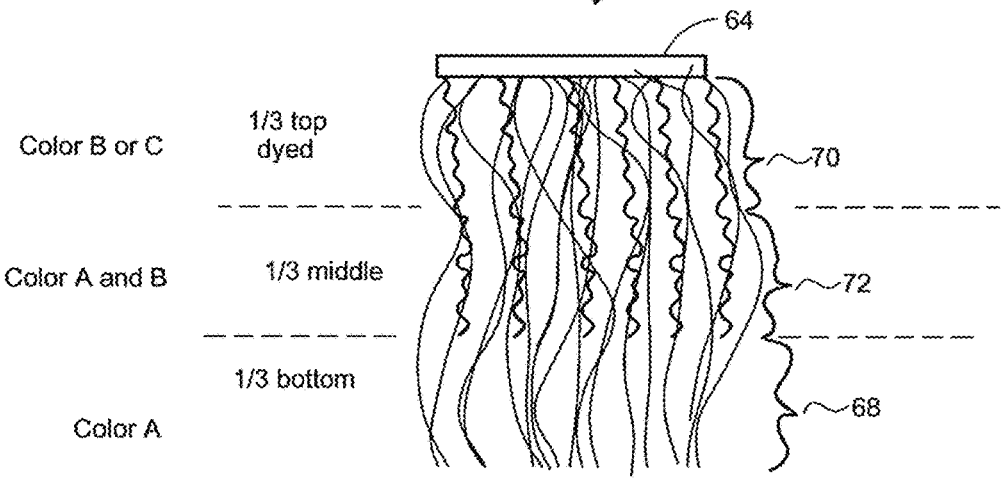

FIGS. 2*a*, 2*b* and 2*c* are flow process schematics showing the starting hair groups 1 and 2, the combination or joinder of hair groups 1 and 2, and the final color processing step.

FIG. 2*a* shows the components of the hair extension prior to combination, namely hair group 1 60 and hair group 2 62. Hair group 1 60 and hair group 2 62 are the same texture hair, but the different hair groups are visually depicted with different wave patterns to distinguish between the two groups. Hair group 1 62 has been color processed to color A and hair group 2 60 has been color processed to color B.

In FIG. 2*b*, hair group 1 60 and hair group 2 62 are combined. The hair groups 60 and 62 are combined by any known method, which can include attachment means by a tape or a foil connection 64. The hair groups 60 and 62 are attached together at the beginning of the hair strands with the hair strands extending therefrom. As shown in FIG. 2*b*, after the combination of hair groups 1 and 2, the top two-thirds (⅔) segment 66 of the combined hair extension includes both hair groups 1 and 2. Therefore, the top two-thirds (⅔) segment 66 results in a visible mixture of the hair strands having colors A and B. The top one-third (⅓) segment 70 of the color is temporary as this portion is dyed in the next steps. See FIG. 2*c*. The mixture of colors A and B is the transitory hair color found in the middle one-third (⅓) segment 72 of the final transitory colored hair. The bottom one-third (⅓) segment 68 of the combined hair extension only includes hair from hair group 2 and only color A is visible in the bottom one-third (⅓) segment 68.

After the hair groups 1 and 2 are combined in FIG. 2*b*, a portion of the hair extension is then dyed or color processed in FIG. 2*c*. The top one-third (⅓) segment 70 is dyed or color processed to be color B or color C. Color B is the same color as hair group 2 60. Alternatively, the top one-third (⅓) segment 70 of the extension can be dyed or color processed to color C, which can be a slightly darker or lighter color than color B. Optionally, color C could be any desired color. Only the top one-third (⅓) segment 70 is dyed in the last step. Dyeing or color processing the top one-third (⅓) segment after the hair groups 1 and 2 are combined, makes the top one-third (⅓) segment 70 a solid color. The middle one-third (⅓) segment 72 of the hair extension is composed of hair strands that are both color A and color B and is considered the transition segment. The bottom one-third (⅓) segment 68 is only composed of hair strands from hair group 1 and is therefore, only one color, color A.

In FIG. 3, an extension is shown using the colors dark brown and purple. The top one-third (⅓) segment 70 of the hair is a base or root color, which is a dark brown. The middle one-third (⅓) segment 72 of the extension is a transition segment, which is a mixture of dark brown strands and purple strands. The bottom one-third (⅓) segment 68 of the hair extension is a purple color alone and includes only the long hair strands from hair group 1. Hair group 1 is typically color processed to be a vibrant color, such as blue, pink, purple, red, green, etc. Thus, the final transitory colored hair results in what appears to be natural colored hair segment 70 transitioning to a vibrant colored hair segment 68 at the bottom, with a mixture of the two colors in the middle segment 72.

While the preferred embodiment of the invention has been described using specific terms, such description is for illustrative purposes only, and it is to be understood that changes and variations may be made without departing from the spirit or scope of the following claims. The claims appended hereto are meant to cover modifications and changes within the scope and spirit of the present invention.

What is claimed is:

1. A process for creating transitory colored hair for a hair extension or a wig comprising:

obtaining a first group of hair consisting of a first plurality of hair strands having a predetermined first length (said predetermined first length being 12 inches to 24 inches in length);

color processing the first group of hair to a first color;

obtaining a second group of hair consisting of a second plurality of hair strands having a predetermined second length which is approximately two-thirds the length of the first predetermined length of the first hair group;

color processing the second hair group to a second color;

joining the first and the second hair groups together at one respective end thereof; and color processing a top one-third segment of the joined first and second hair groups to said second color;

wherein the joined hair groups are transitory colored.

2. The process of claim 1, wherein the first hair group has an x volume of hair strands therein.

3. The process of claim 2, wherein the second hair group has a y volume of hair strands therein and wherein y hair strand volume is less than x hair strand volume.

4. The process of claim 2, wherein the first hair group has a volume of hair strands that is 60% of the joined hair.

5. The process of claim 3, wherein the second hair group has a volume of hair strands that is 40% of the joined hair.

6. The process of claim 1, wherein the first color is a vibrant color selected from the group consisting of blue, red, purple, pink, orange, yellow, teal, silver, violet and green.

7. The process of claim 1, wherein the second color is a hair color selected from the group consisting of shades of blonde, brown, and black.

8. The process of claim 1, wherein the process produces a transitory colored hair having three visible colored segments consisting of a top one-third colored segment, a middle one-third colored segment and a bottom one-third colored segment.

9. The process of claim 1, further comprising joining the first and second hair groups with tape at an end of the hair strands at the top one-third segment of the joined hair groups.

10. The process of claim 1, further comprising joining the first and second hair groups with a foil mount at an end of hair strands at the top one-third segment of the joined hair groups.

11. The process of claim 1, wherein the first predetermined length is between 12 inches to 24 and the second predetermined length is approximately two-thirds the length of the first predetermined length.

12. A process for creating transitory colored hair for an extension or wig comprising:

obtaining a hair group 1 consisting of hair strands 12 inches to 24 inches in length;

color processing the hair group 1 to a color A;

obtaining a hair group 2 consisting of hair strands approximately two-thirds the length of the hair group 1;

color processing the hair group 2 to a color B;

combining the hair group 1 and the hair group 2; and color processing a top one-third segment of a combined hair to a color C.

13. The process of claim 12, wherein the hair group 1 has a volume of hair strands x.

14. The process of claim 13, wherein the hair group 2 has a volume of hair strands y and y is less than x.

15. The process of claim 13, wherein the hair group 1 has a volume of hair strands that is 60% of the combined hair.

16. The process of claim 14, wherein the hair group 2 has a volume of hair strands that is 40% of the combined hair.

17. The process of claim 12, wherein the color A is a vibrant color selected from the group consisting of blue, red, purple, pink, orange, yellow, teal, silver, and green.

18. The process of claim 12, wherein the color B is a hair color selected from the group consisting of shades of blonde, brown, and black.

19. The process of claim 12, wherein the process produces a transitory colored hair having three visible segments consisting of the top one-third segment, a middle one-third segment and a bottom one-third segment.

20. The process of claim 12, further comprising combining hair groups 1 and 2 with a tape at an end of hair strands in the top one-third segment of the combined hair.

21. The process of claim 12, further comprising combining hair group 1 and 2 with a foil at an end of hair strands in the top one-third segment of the combined hair.

* * * * *